US008299887B2

(12) United States Patent
Ohtsuka et al.

(10) Patent No.: US 8,299,887 B2
(45) Date of Patent: Oct. 30, 2012

(54) SELF-RECOVERY CURRENT LIMITING FUSE

(75) Inventors: Shinya Ohtsuka, Kitakyushu (JP); Hiroki Suetomi, Kitakyushu (JP); Fumihiro Akiyoshi, Kitakyushu (JP); Hiroo Arikawa, Minato-ku (JP)

(73) Assignees: Kyushu Institute of Technology, Fukuoka (JP); Soc Corporation, Tokyo (JP)

( * ) Notice: Subject to any disclaimer, the term of this patent is extended or adjusted under 35 U.S.C. 154(b) by 213 days.

(21) Appl. No.: 12/741,464

(22) PCT Filed: Oct. 20, 2008

(86) PCT No.: PCT/JP2008/068942

§ 371 (c)(1),
(2), (4) Date: May 5, 2010

(87) PCT Pub. No.: WO2009/060709

PCT Pub. Date: May 14, 2009

(65) Prior Publication Data

US 2010/0259354 A1 Oct. 14, 2010

(30) Foreign Application Priority Data

Nov. 9, 2007 (JP) ..... 2007-291555

(51) Int. Cl.
*H01H 85/055* (2006.01)

(52) U.S. Cl. ..... 337/167; 337/21

(58) Field of Classification Search ..... 337/21, 337/167

See application file for complete search history.

(56) References Cited

U.S. PATENT DOCUMENTS

| | | | | | |
|---|---|---|---|---|---|
| 3,002,071 | A * | 9/1961 | Storsand | 337/158 |
| 3,515,829 | A * | 6/1970 | Hurtle et al. | 218/31 |
| 3,838,373 | A * | 9/1974 | Inoue et al. | 337/21 |
| 4,401,870 | A * | 8/1983 | St-Jean | 218/26 |
| 5,416,462 | A | 5/1995 | Demarmels et al. | |
| 5,471,185 | A * | 11/1995 | Shea et al. | 335/51 |
| 5,581,192 | A * | 12/1996 | Shea et al. | 324/722 |
| 5,691,689 | A * | 11/1997 | Smith et al. | 338/22 R |
| 5,796,569 | A * | 8/1998 | Gronowicz, Jr. | 361/106 |
| 5,907,272 | A * | 5/1999 | McGuire | 338/22 R |
| 6,362,722 | B1 * | 3/2002 | Cole et al. | 338/22 R |
| 6,489,879 | B1 * | 12/2002 | Singh et al. | 337/167 |
| 6,525,642 | B1 * | 2/2003 | Kremers et al. | 338/80 |
| 6,600,405 | B1 * | 7/2003 | Kremers et al. | 337/21 |
| 6,603,384 | B1 * | 8/2003 | Kremers et al. | 337/21 |
| 6,621,401 | B1 * | 9/2003 | Kremers et al. | 337/21 |
| 7,626,483 | B2 * | 12/2009 | Ohtsuka et al. | 337/167 |
| 2003/0048619 | A1 | 3/2003 | Kaler et al. | |
| 2007/0241856 | A1 * | 10/2007 | Ohtsuka et al. | 337/160 |
| 2009/0315664 | A1 * | 12/2009 | Crane et al. | 337/227 |

FOREIGN PATENT DOCUMENTS

JP 6-215903 8/1994

(Continued)

*Primary Examiner* — Anatoly Vortman

(74) *Attorney, Agent, or Firm* — McGlew and Tuttle, P.C.

(57) ABSTRACT

A liquid matrix of a nonmagnetic material is accommodated within an insulative container of a nonmagnetic material, and a pair of electrodes is disposed within the insulative container such that the electrodes face each other via the liquid matrix. Conductive particles are fluidly dispersed in the liquid matrix. A magnetic field generation section is provided externally of the insulative container so as to generate a magnetic field in a direction orthogonal to a fuse element to be formed between the paired electrodes through chaining of the solid particles.

20 Claims, 6 Drawing Sheets

FOREIGN PATENT DOCUMENTS

| | | |
|---|---|---|
| JP | 09-326302 | 12/1997 |
| JP | 2000-331592 | 11/2000 |
| JP | 2002-075329 | 3/2002 |
| JP | 2003-317602 | 11/2003 |
| JP | 2005-285999 | 10/2005 |
| JP | 3955956 B2 | 8/2007 |

* cited by examiner

-- Prior Art --

SELF-RECOVERY CURRENT LIMITING FUSE

TECHNICAL FIELD

The present invention relates to a self-recovery current limiting fuse which establishes a conducting state through chaining of conductive particles in a liquid matrix and can reliably perform a cutoff operation upon occurrence of overcurrent.

BACKGROUND ART

In recent years, electronic equipment, such as cellular phones and notebook computers, use devices whose resistance has a positive temperature coefficient, or PTC devices, as protective devices for secondary cells. Demand exists for such electronic equipment to implement high functionality, long-hour operability, and higher efficiency. Under the circumstances, secondary cells are required to implement large capacity and high voltage. In association with these requirements, PTC devices are required to withstand high voltage. At present, PTC devices of about 8 V are in practical use. For withstanding higher voltage, insulation performance in a current limiting condition, which is an OFF state, must be enhanced; i.e., dielectric strength must be enhanced. Mainstream materials for matrices of conventional PTC devices are solid materials, such as ceramics and polymers. For example, polyethylene-based PTC devices and barium-titanate-based PTC devices are used (refer to Patent Documents 1 and 2).

FIG. 7 is a pair of views showing the principle of a basic operation of a conventional PTC device, wherein (a) shows an ON state, and (b) shows an OFF state. The PTC device has a structure in which conductive particles serving as filler are mixed in a solid insulator, such as ceramics or a polymer; i.e., in a solid matrix. Normally, the PTC device is in an ON state, in which the conductive particles are in contact with one another and bridge the electrodes as shown in (a) of FIG. 7, thereby forming a conductive path. When the PTC device is brought into a high-temperature state as a result of inflow of overcurrent thereto, the conductive path is cut as a result of evaporation of the conductive particles or expansion of the solid matrix as shown in (b) of FIG. 7. As a result, resistance increases abruptly, and the PTC device is brought into a cutoff/current-limiting state; i.e., an OFF state. In this manner, in the conventional PTC device configured such that the conductive particles are present in the solid matrix, an OFF state is established by cutting the path of conductive filler through expansion of the matrix.

At present, PTC devices of low dielectric strength are widely used as protective devices for lithium ion cells for use in cellular phones and computers. However, in association with implementation of large-capacity cells, PTC devices of high dielectric strength are required. For a structural reason, a solid matrix involves the generation of cracks and voids in principle when the solid matrix expands. Since gas is present in such cracks and voids surrounded by the solid matrix having high dielectric constant, an electric field concentrates in cracks and voids, so that discharge is apt to be generated in cracks and voids. For this reason, a PTC device using a solid matrix suffers material deterioration caused by gaseous discharge, resulting in impairment in recovering characteristics. Thus, under present circumstances, difficulty is encountered in fabricating a reliably usable PTC device of 8 V or higher, depending on a PTC device structure.

Under the above-mentioned technological circumstances, the inventors of the present invention filed an application for a self-recovery current limiting fuse using a liquid matrix, which can suppress the generation of cracks and voids as compared with a solid matrix (refer to Patent Document 3). The self-recovery current limiting fuse using a liquid matrix disclosed in Patent Document 3 enhances dielectric strength through suppression of generation of cracks and voids and implements self-restoration characteristics by means of dielectrophoretic force of solid conductive particles generated through application of voltage. Thus, by means of solid conductive particles being mixed in a liquid matrix; i.e., solid conductive particles being fluidly dispersed in a liquid matrix, contact electric-resistance, or ON resistance, can be lowered; through enhancement of dielectric strength, a secondary cell having high rated voltage is protected; the range of applications is expanded; efficiency is improved; charging time is shortened; and maintenance-free operation is attained.

According to Patent Document 3, fusion cutting of a fuse element by overcurrent is utilized for operational change from an ON state to an OFF state. Specifically, when overcurrent flows between electrodes in an ON state, in which solid conductive particles are chained in a liquid matrix for establishment of a conducting state, Joule heat is generated in the liquid matrix. As a result, the solid conductive particles evaporate and disperse, whereby a cutoff/current-liming operation is effected, thereby establishing a cutoff/current-limiting state. Because of utilization of evaporation of solid conductive particles, particularly in the case of use of a fuse element having high melting point, some difficulty is involved in transfer to an OFF state. Also, the self-recovery current limiting fuse of Patent Document 3 does not have an emergency trip function.

Patent Document 1: Japanese Patent Application Laid-Open (kokai) No. H6-215903

Patent Document 2: Japanese Patent Application Laid-Open (kokai) No. 2005-285999

Patent Document 3: Japanese Patent No. 3955956

DISCLOSURE OF THE INVENTION

Problems to be Solved by the Invention

An object of the present invention is to solve the above-mentioned problems for more reliably performing a cutoff operation upon occurrence of overcurrent in a self-recovery current limiting fuse which establishes a conducting state through chaining of conductive particles in a liquid matrix by use of dielectrophoretic force.

The present invention devises an arrangement of current flowing to a device, a magnetic field applied to the device, and electrodes and a fuse element (conductive substance) of a self-recovery current limiting fuse so as to perform a cutoff operation of the self-recovery current limiting fuse through operation of the fuse element by means of an interaction of the current and the magnetic field (electromagnetic force). Thus, particularly in the case of use of a fuse element having high melting point, the present invention provides effective, indispensable cutoff means.

Also, the present invention may be applied to an emergency trip function and contributes to functional (safety) improvement of a device.

Means for Solving the Problems

A self-recovery current limiting fuse of the present invention is configured as follows. A liquid matrix of a nonmagnetic material is accommodated within an insulative container of a nonmagnetic material, and a pair of electrodes are disposed within the insulative container such that the electrodes face each other via the liquid matrix. Conductive particles are fluidly dispersed in the liquid matrix. A magnetic field generation section is provided externally of the insulative container and adapted to generate a magnetic field having a component in a direction orthogonal to a fuse element to be formed between the paired electrodes through chaining of the conductive particles.

In an ON state in which the conductive particles are chained between the paired electrodes, a dielectrophoretic force which acts on the conductive particles in the liquid matrix through application of voltage to the paired electrodes causes the conductive particles to be continuously connected to one another. Upon occurrence of overcurrent, an electromagnetic force generated through interaction between the magnetic field generated by the magnetic field generation section and current flowing to the fuse element cuts the fuse element or pushes out the fuse element from the electrodes, thereby establishing an OFF state. In this manner, the ON state and the OFF state are repeated.

Also, the self-recovery current limiting fuse of the present invention further comprises a magnetic-field-intensity-varying apparatus capable of varying magnetic field intensity of the magnetic field generation section. Upon reception of a signal indicative of detection of overcurrent from an overcurrent detection section provided in series with the self-recovery current limiting fuse, or an emergency trip signal or an OFF operation check signal from an emergency trip input section, the magnetic-field-intensity-varying apparatus greatly varies the magnetic field intensity for bringing the fuse element into an OFF state.

Effects of the Invention

According to the present invention, a fuse element material having high melting point can be cut based on a new cutoff principle different from conventional fusion cutting of a fuse element. Also, the present invention contributes to improvement of safety by providing operation check and emergency trip function, thereby expanding the range of use and application of devices.

According to the present invention, 1) an OFF operation can be performed without need to melt particles (even when unfusible particles are used), and 2) a reset function for checking an OFF operation like a test button of an earth leakage breaker may be added, thereby ensuring safe usage.

BRIEF DESCRIPTION OF THE DRAWINGS

FIGS. 4(A) to 4(D) are a series of views showing electrode shapes, wherein FIGS. 4(A) and 4(B) are views showing electrode shapes similar to those shown in FIGS. 1 and 3, respectively, and 4(C) and 4(D) are views for explaining inappropriate electrode shapes.

BEST MODE FOR CARRYING OUT THE INVENTION

Figure 1:
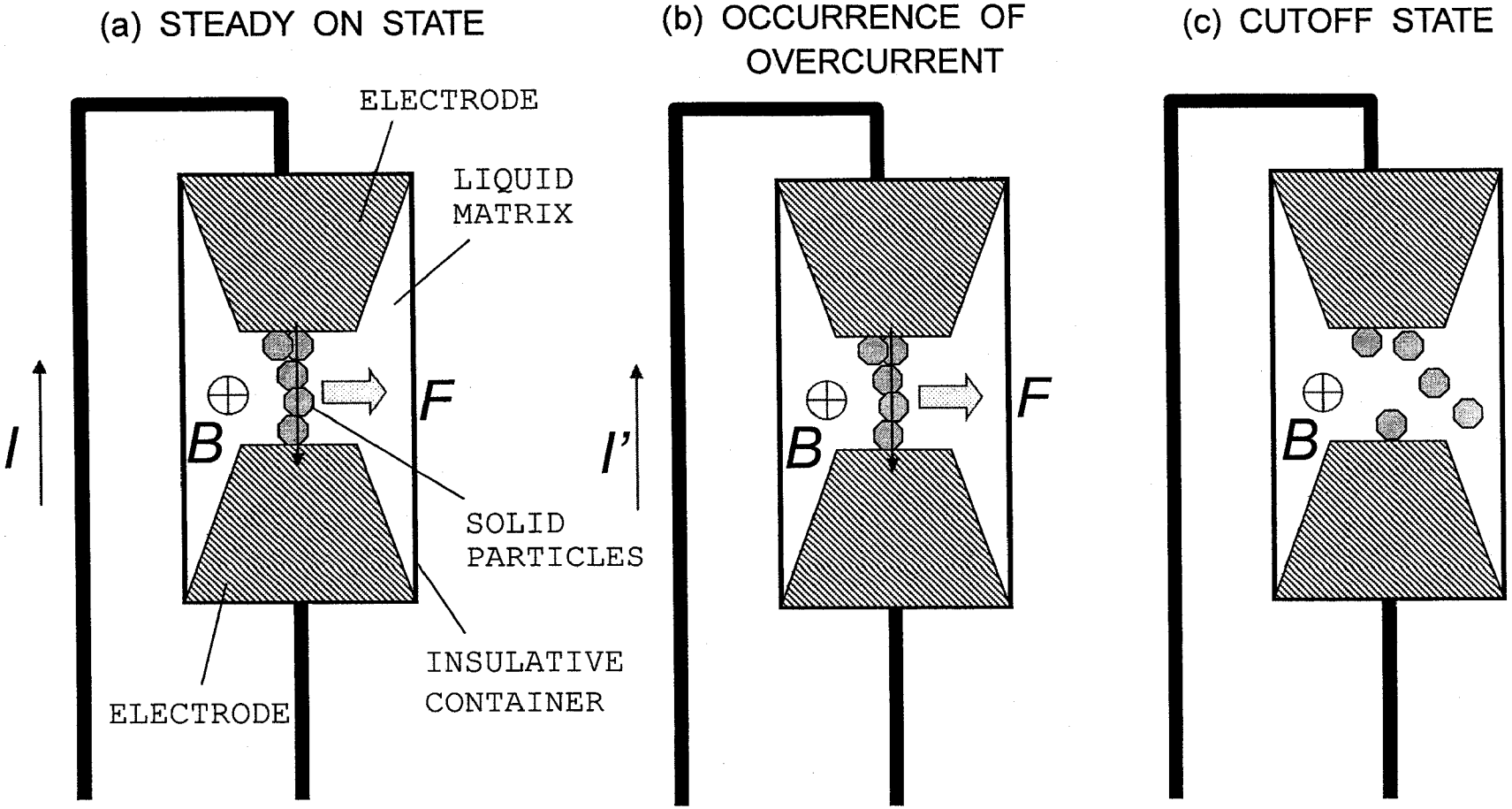
FIG. 1 is a series of views showing a schematic configuration of a self-recovery current limiting fuse using dielectrophoretic force of the present invention, wherein (a) is a view showing a steady ON state and (b) and (c) are views for explaining operations upon occurrence of overcurrent and in a cutoff state, respectively.

The present invention will be described by way of example. FIG. 1 is a series of views showing a schematic configuration of a self-recovery current limiting fuse using dielectrophoretic force of the present invention, wherein (a) is a view showing a steady ON state and (b) and (c) are views for explaining operations upon occurrence of overcurrent and in a cutoff state, respectively. The illustrated self-recovery current limiting fuse of the present invention is configured as follows. A liquid matrix of a nonmagnetic material is accommodated within an insulative container of a nonmagnetic material, and a pair of electrodes is disposed counter to each other via the liquid matrix. The insulative container has a circular or rectangular cross section and has a predetermined longitudinal length. The paired electrodes are fixed internally of the insulative container. External wiring lines are connected to the respective paired electrodes. Conductive solid particles are fluidly dispersed in the liquid matrix. A magnetic field generation section is provided externally of the insulative container. Use of solid particles serving as conductive particles is discussed below by way of illustration. However, conductive particles are not limited to solid particles. Conductive liquid particles, such as mercury particles, may also be used.

The magnetic field generation section is disposed such that an electromagnetic force generated through interaction between a magnetic field generated by the magnetic field generation section and current flowing to a fuse element (chain of solid particles) in association with overcurrent cuts the fuse element or pushes out the fuse element from the electrodes. In FIG. 1, the magnetic field generation section is disposed such that a magnetic field having a component in a direction orthogonal to the fuse element is generated in a direction from the front side toward the back side of the paper on which FIG. 1 appears. The generated magnetic field suffices so long as its component orthogonal to the fuse element has sufficient intensity. However, rendering the generated magnetic field orthogonal to the fuse element enables the generated magnetic field to efficiently act on the fuse element. A permanent magnet or a coil may be used as the magnetic field generation section. A wiring line to the self-recovery current limiting fuse may be positioned such that current flowing through the wiring line generates a magnetic field. The positioning of the wiring line suffices so long as a magnetic field required for initiation of an OFF operation is generated upon occurrence of set overcurrent. Alternatively, a magnetic field generated from the wiring line may be used in combination with a permanent magnet or a magnetic field generation coil. The intensity of a magnetic field generated by the magnetic field generation section is varied by means of varying a relative position between the insulative container and such magnetic field sources or varying the number of turns of the magnetic field generation coil.

In a steady ON state shown in (a) of FIG. 1, power from a power supply (not shown) is supplied to a load (not shown) via the illustrated self-recovery current limiting fuse. Thus, voltage is applied between the electrodes of the self-recovery current limiting fuse. Since solid particles in the liquid matrix are electrically conductive, a dielectrophoretic force $F_{DEP}$ acts on the solid particles. Thus, as shown in (a) of FIG. 1, the conductive solid particles are continuously connected to one another, thereby forming a conductive path (fuse element). At this time, through interaction between current I flowing to the fuse element and magnetic field intensity B of a magnetic field generated by the magnetic field generation section in a direction from the front side toward the back side of the paper on which (a) of FIG. 1 appears, an electromagnetic force F acts on the fuse element in a direction orthogonal to the fuse element and orthogonal to the direction of the magnetic field. The electromagnetic force F is known to be expressed by F=IBL, where L is the length of the fuse element equivalent to the distance between the electrodes; i.e., the electromagnetic force F is proportional to the current I. Thus, the magnetic field intensity B of the magnetic field generation section and the viscosity of the liquid matrix are preset appropriately such that, in a steady ON state, the electromagnetic force F does not grow to such a magnitude as to cut the conductive path.

Figure 2:
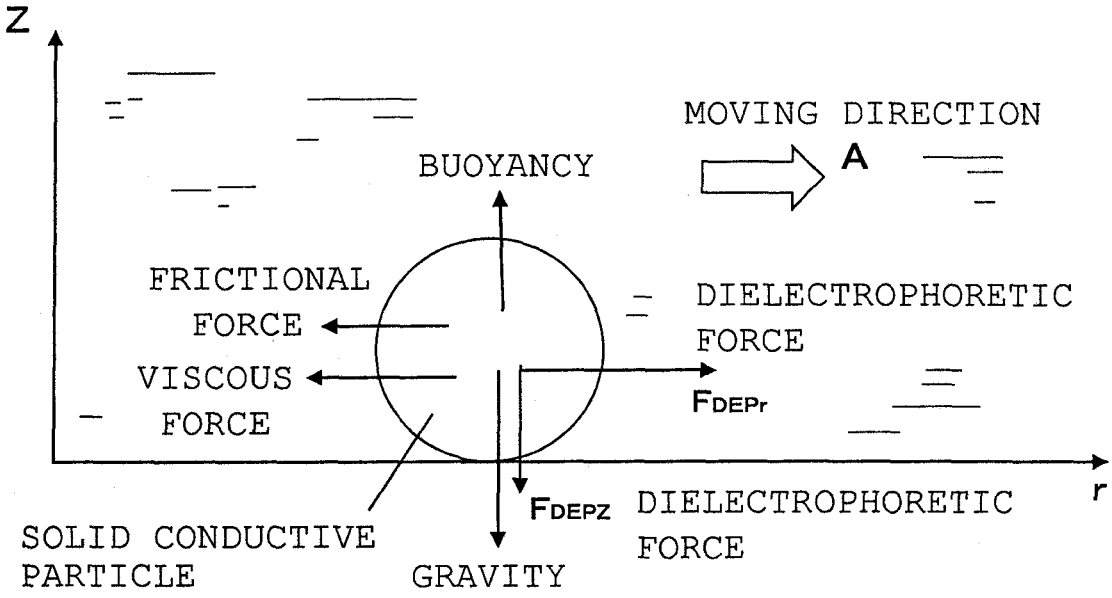
FIG. 2 is a view showing a dielectrophoretic force $F_{DEP}$ which acts on a solid conductive particle in a liquid matrix.

FIG. 2 shows a dielectrophoretic force $F_{DEP}$ which acts on a solid conductive particle in a liquid matrix. In an ON state in which solid conductive particles are mixedly dispersed in the liquid matrix and a voltage is applied between the electrodes, the dielectrophoretic force $F_{DEP}$ consisting of a horizontal component $F_{DEPr}$ and a vertical component $F_{DEPz}$ acts on the solid conductive particles. Specifically, as shown in FIG. 2, gravity, a viscous force, buoyancy, and a frictional force act on a solid conductive particle in the liquid matrix, whereby the dielectrophoretic force $F_{DEP}$ acts on the solid conductive particle. As a result, a motion of the solid conductive particle in the direction of arrow A is developed.

In a steady ON state shown in (a) of FIG. 1, by virtue of the dielectrophoretic force $F_{DEP}$ acting on the solid particles in the liquid matrix, the solid particles are efficiently gathered or collected between the electrodes and chained to one another. As a result of occurrence of such a phenomenon, a conductive path is formed in the form of a pearl chain of solid particles, thereby establishing an ON state; i.e., a conducting state.

Next, suppose that overcurrent flows to the self-recovery current limiting fuse as shown in (b) of FIG. 1. At this time, a large electromagnetic force F generated in proportion to the overcurrent acts on conductive solid particles, thereby cutting a fuse element in the form of chained solid particles or pushing out the fuse element from the electrodes.

(c) of FIG. 1 shows a state in which the fuse element is cut as mentioned above. Although a current path is cut, voltage from the power supply is still applied between the electrodes. In this state, the dielectrophoretic force $F_{DEP}$ acts on the solid particles floating in the liquid matrix, so that the solid particles are collected between the electrodes and bridge the electrodes; i.e., the solid particles are chained between the electrodes. Thus, a conducting state; i.e., an ON state shown in (a) of FIG. 1 is again established.

In this manner, the solid particles in the liquid matrix are collected between the electrodes and restored to the form of a pearl chain between the electrodes, whereby an OFF state is changed to an ON state. Again, in an ON state, in which the solid particles are chained, when overcurrent flows to the self-recovery current limiting fuse, the ON state is changed to an OFF state. In this manner, the self-recovery current limiting fuse repeats changeover between the above-mentioned states, thereby carrying out a self-recovery function.

Figure 3:
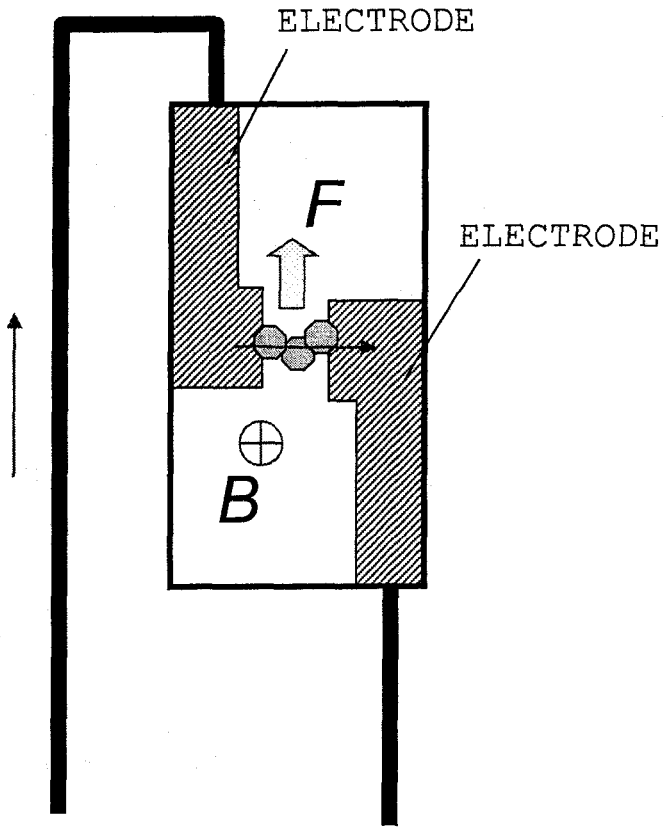
FIG. 3 is a View showing a schematic configuration of another self-recovery current limiting fuse using dielectrophoretic force of the present invention.

FIG. 3 is a view showing a schematic configuration of another self-recovery current limiting fuse using dielectrophoretic force of the present invention. The illustrated self-recovery current limiting fuse uses a pair of L-shaped electrodes. The illustrated self-recovery current limiting fuse also functions similarly to the self-recovery current limiting fuse which has been described with reference to FIG. 1. Each of the paired electrodes must be formed into a sloped or stepped shape or the like such that the distance between the electrodes increases gradually or suddenly, and, in a region where ends of the electrodes face each other, the electrodes are cut off at least on the side toward which the electromagnetic force F acts. The resultant space must be filled with the liquid matrix. This will be further described with reference to FIGS. 4(A) to 4(D).

Figure 4A:
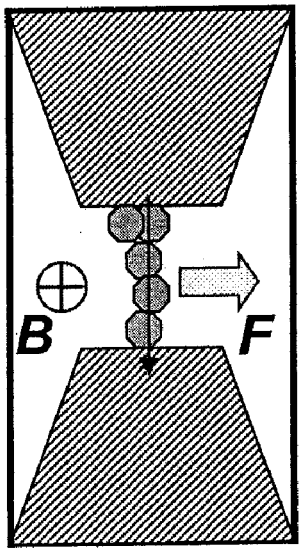
Figure 4B:
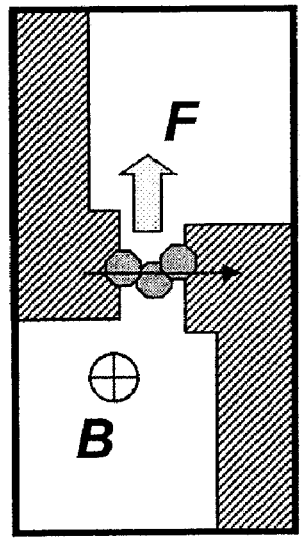
Figure 4C:
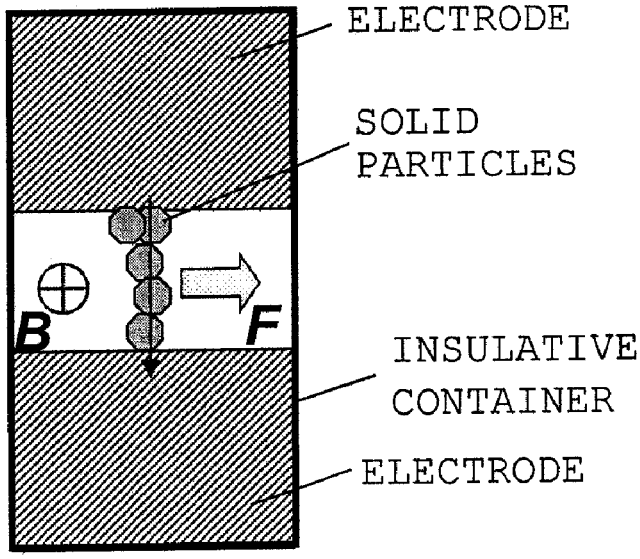
Figure 4D:
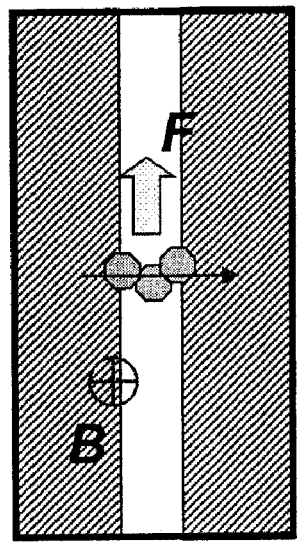

FIGS. 4(A) and 4(B) show electrode shapes similar to those shown in FIGS. 1 and 3, respectively. FIGS. 4(C) and 4(D) are views for explaining inappropriate electrode shapes. According to the inappropriate electrode shapes shown in FIGS. 4(C) and 4(D), the electrodes extend to the walls of the insulative container, and the gap between the facing ends of the electrodes is constant. Thus, even when the electromagnetic force F associated with overcurrent acts on the solid particles in the illustrated direction, a chain of the solid particles is merely biased toward either side and remains in contact with the electrode ends; therefore, cutting the chain is difficult. By contrast, in the case of the electrode shapes shown in FIGS. 4(A) and 4(B), the electromagnetic force F associated with overcurrent causes a chain of the solid particles to come off the electrode ends, thereby cutting the chain.

Thus, each of the electrodes is formed into such a shape as to form a non-uniform electric field, to allow easy contact of particles with the electrodes, and to avoid an increase in contact resistance; for example, into a sloped or stepped shape or the like, in which the height increases gradually, whereby, in a region where the ends of the paired electrodes face each other, a gap is formed between the insulative container and side surfaces of the electrodes.

The electrodes may be formed from a high-melting-point material or an alloy which contains the high-melting-point material, and the high-melting-point material and the alloy are resistant to arc and electrolytic corrosion. For example, each of the electrodes may be configured such that a thin film of one or more conductive metals selected from the group consisting of Al, Cu, Ag, Au, Ni, and Cr is formed on an oxide film formed on a glass substrate or a metal substrate. Also, the electrodes may be configured by use or addition of a high-melting-point material, such as W, Ti, or stainless steel, for enabling repeated use.

Figure 5:
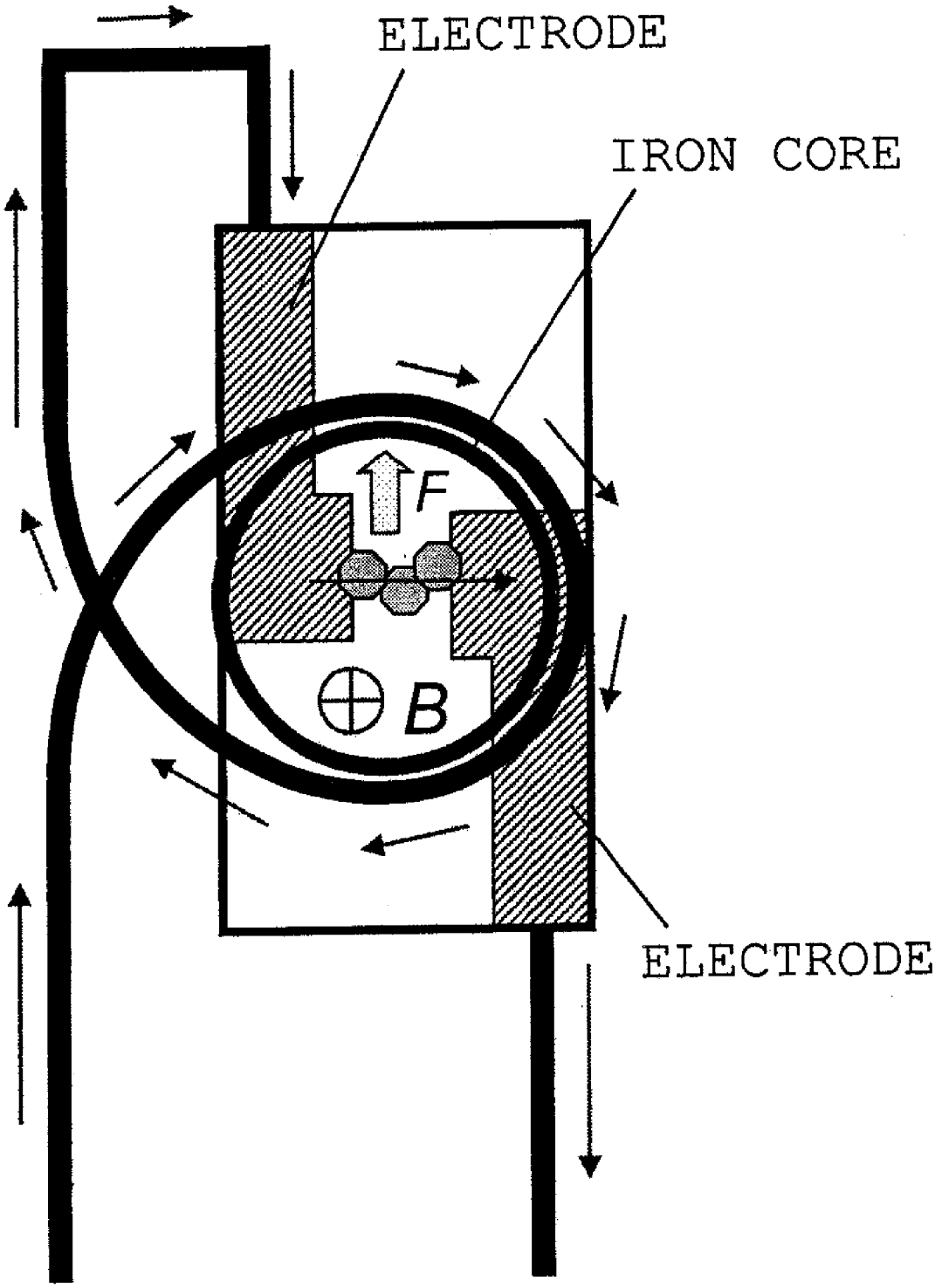
FIG. 5 is a view for explaining the generation of magnetic field.

FIG. 5 is a view for explaining the generation of magnetic field. As mentioned above, a permanent magnet or an electromagnet may be used as the magnetic field generation section. In this case, in FIG. 5, the magnetic field generation section is disposed such that a magnetic field B is generated perpendicular to the paper on which FIG. 5 appears; for example, in a direction from the front side toward the back side of the paper. Also, a wiring line to the self-recovery current limiting fuse may be positioned in such a manner as to generate a magnetic field by means of current flowing therethrough. In this case, a magnetic field may be generated simply from a wiring line positioned in parallel with the self-recovery current limiting fuse. However, in order to ensure a sufficient electromagnetic force, as illustrated, a cylindrical iron core is disposed concentrically with the fuse element, and a wiring line is wound around the iron core by one or more than one turns, thereby forming a coil for generating a magnetic field.

Figure 6:
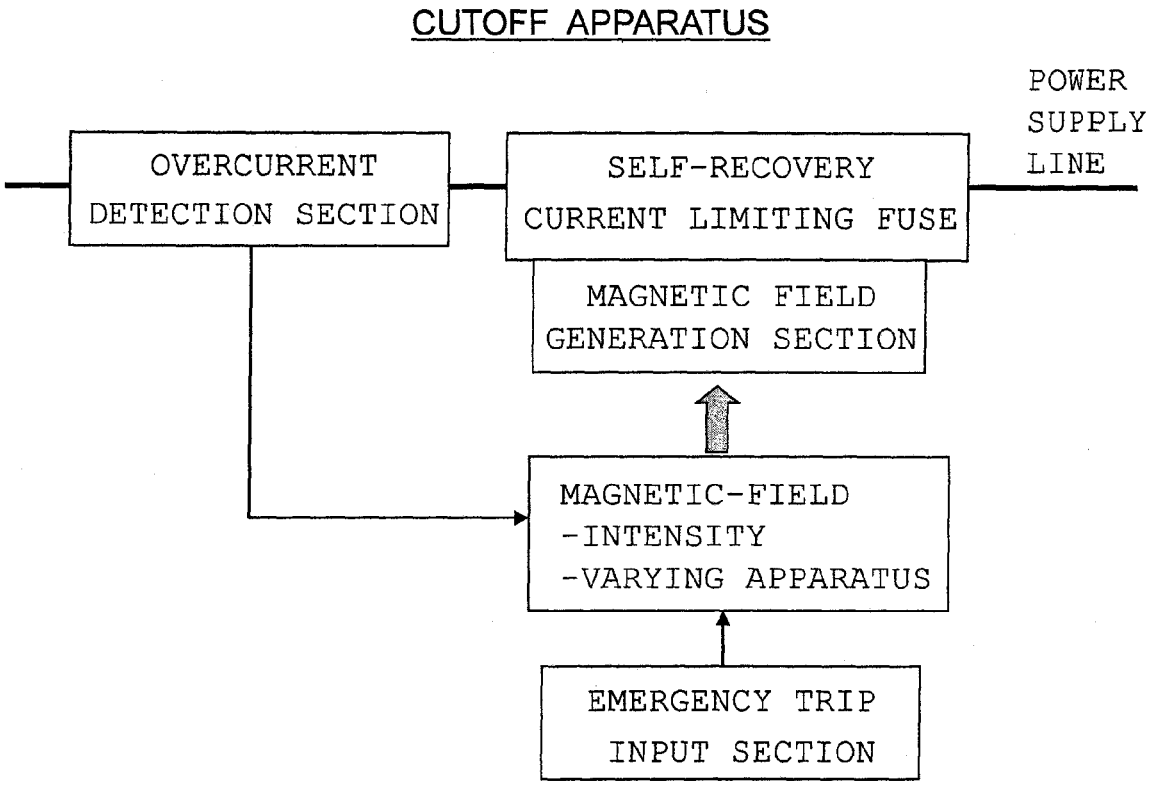
FIG. 6 is a view showing a cutoff apparatus for varying magnetic field intensity for bringing the self-recovery current limiting fuse of the present invention to an OFF state.
Figure 7:
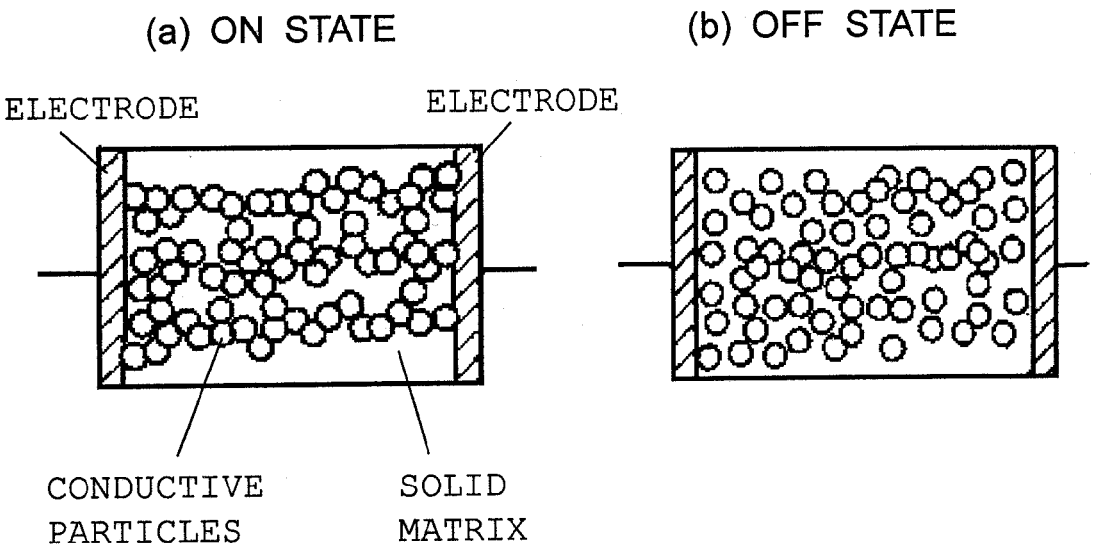
FIG. 7 is a pair of views showing the principle of a basic operation of a conventional PTC device, wherein (a) shows an ON state, and (b) shows an OFF state.

FIG. 6 is a view showing a cutoff apparatus for varying magnetic field intensity for bringing the self-recovery current limiting fuse of the present invention to an OFF state. As illustrated, the self-recovery current limiting fuse, which has been described with reference to FIG. 1 or FIG. 3, and an overcurrent detection section are provided in series in a power supply line. Further, there is provided a magnetic-field-intensity-varying apparatus capable of varying the magnetic field intensity of the magnetic field generation section attached to the self-recovery current limiting fuse.

When the overcurrent detection section detects overcurrent, the magnetic-field-intensity-varying apparatus greatly varies magnetic field intensity. The magnetic-field-intensity-varying apparatus is configured to be able to carry out cutoff even when overcurrent does not flow, upon reception of an emergency trip signal or an OFF operation check signal from an emergency trip input section. The magnetic field intensity may be varied by means of varying the position of a permanent magnet, if used, or varying a coil position or coil current, if a coil is used. The electromagnetic force F (=IBL) which acts on the solid particles of the self-recovery current limiting fuse is also proportional to the magnetic field intensity B of the magnetic field generation section. Therefore, in an emergency, by means of greatly varying the magnetic field intensity B, the self-recovery current limiting fuse may be externally brought to an OFF state.

Also, the self-recovery current limiting fuse may be used as a protection device against mechanical shock. Specifically, upon subjection to mechanical shock or vibration in the event of, for example, earthquake or collision, a pearl chain of solid particles connected to one another is cut, thereby cutting off current. Thus, the self-recovery current limiting fuse may be utilized as an emergency device against disaster or as a protective device against shock. The restoration speed from an OFF state to an ON state of the self-recovery current limiting fuse may be adjusted for applications by means of selection of a liquid matrix from among those of different viscosities and setting of electric field intensity through determination of electrode shape and a gap between electrodes.

In the self-recovery current limiting fuse of the present invention, a magnetic field generated by the magnetic field generation section acts on solid particles. Thus, the liquid matrix must be of a nonmagnetic material. For example, the liquid matrix may be of one or more materials selected from the group consisting of deionized water, including pure water, insulative oil, insulative organic polymeric material, and insulative organic polymeric material gel. The ON resistance of the liquid matrix can be lowered by means of cooling particles and metals, such as electrodes, by use of cooling medium, such as liquid nitrogen.

A conceivable liquid matrix encompasses not only liquid, which has complete fluidity, but also a gel substance. A self-recovery current limiting fuse using a gel substance has an advantage in that distant dispersion of solid particles, which causes a drop in efficiency of collection of solid particles, can be prevented, and liquid leakage or a like problem can be avoided in actual use.

The solid particles which serve as filler must be of a conductive material for forming a current path in an ON state. Additionally, in order for a dielectrophoretic force to act on the solid particles for restoration from an OFF state to an ON state, the solid particles must be of a conductive material. For example, one or more types of particles selected from among tin (Sn) particles, zinc (Zn) particles, indium (In) particles, bismuth (Bi) particles, etc., and one or more types of particles selected from among carbon particles, copper (Cu) particles, aluminum (Al) particles, silver (Ag) particles, gold (Au) particles, etc. may be mixedly used as material for the solid particles. Also, for example, mercury (Hg) may be used as a liquid material.

EXAMPLE

Example values for the self-recovery current limiting fuse of the present invention are as follows. The fuse device measures 30 mm×16 mm, and steady-state current is several mA to several tens of A. Cutoff was confirmed with an overcurrent ranging from 0.5 A to 7 A. The gap between the electrodes was, for example, 30 μm in the case of a narrow gap, and 150 μm in the case of a wide gap.

The invention claimed is:

1. A self-recovery current limiting fuse comprising:

an insulative container of a nonmagnetic material;

a liquid matrix of a nonmagnetic material accommodated within the insulative container;

a pair of electrodes disposed within the insulative container such that the electrodes face each other via the liquid matrix;

conductive particles fluidly dispersed in the liquid matrix; and a magnetic field generation section provided externally of the insulative container and adapted to generate a magnetic field having a component in a direction orthogonal to a fuse element to be formed between the paired electrodes through chaining of the conductive particles, wherein upon occurrence of overcurrent, an electromagnetic force generated through interaction between the magnetic field generated by the magnetic field generation section and current flowing through said fuse element establishes an OFF state.

2. A self-recovery current limiting fuse according to claim 1, wherein, in an ON state in which the conductive particles are chained between the paired electrodes, a dielectrophoretic force which acts on the conductive particles in the liquid matrix through application of voltage to the paired electrodes causes the conductive particles to be continuously connected to one another; and upon occurrence of overcurrent, the electromagnetic force cuts the fuse element or pushes out the fuse element from the electrodes, thereby establishing the OFF state, so that the ON state and the OFF state are repeated.

3. A self-recovery current limiting fuse according to claim 1, wherein each of the paired electrodes is formed into a sloped or stepped shape such that a distance between the electrodes increases gradually or suddenly.

4. A self-recovery current limiting fuse according to claim 1, wherein the paired electrodes are formed from a high-melting-point material or an alloy which contains the high-melting-point material, and the high-melting-point material and the alloy are resistant to arc and electrolytic corrosion.

5. A self-recovery current limiting fuse according to claim 1, further comprising a magnetic-field-intensity-varying apparatus capable of varying magnetic field intensity of the magnetic field generation section, wherein, upon reception of a signal indicative of detection of overcurrent from an overcurrent detection section provided in series with the self-recovery current limiting fuse, or an emergency trip signal or an OFF operation check signal from an emergency trip input section, the magnetic-field-intensity-varying apparatus greatly varies the magnetic field intensity for bringing the fuse element into an OFF state.

6. A self-recovery current limiting fuse according to claim 1, wherein a permanent magnet, a magnetic field generation coil, or a magnetic field generated by current flowing through a wiring line to the self-recovery current limiting fuse is used singly or in combination as the magnetic field generation section.

7. A self-recovery current limiting fuse according to claim 6, wherein intensity of a magnetic field generated by the magnetic field generation section is varied by means of varying a relative position between the magnetic field generation section and the insulative container or varying current applied to the magnetic field generation coil.

8. A self-recovery current limiting fuse according to claim 1, wherein setting of cutoff current is varied by means of varying intensity of a magnetic field generated by the magnetic field generation section.

9. A self-recovery current limiting fuse comprising:

an insulated container comprising a nonmagnetic material;

a liquid matrix comprising a nonmagnetic material, said liquid matrix being arranged in the insulated container;

a pair of electrodes arranged in said insulated container, one of said pair of electrodes being opposite another one of said pair of electrodes, at least a portion of said liquid being provided between said one of said pair of electrodes and said another one of said pair of electrodes;

conductive particles dispersed in said liquid matrix, said conductive particles comprising an on state and an off state, each of said conductive particles being connected to one another to form a fuse element in said on state, said fuse element extending between said pair of electrodes in said on state, each of said conductive particles being located at a spaced location in said off state; and a magnetic field generation section provided at a location outside of the insulated container, said magnetic field generation section generating a magnetic field having a magnetic field component in a direction perpendicular to said fuse element, wherein a resultant electromagnetic force from said magnetic field and current passing through said fuse element is generated when an overcurrent is present through the fuse element, said conductive particles switching from said on state to said off state via said resultant electromagnetic force.

10. A self-recovery current limiting fuse according to claim 9, wherein each of the paired electrodes is formed into a sloped or stepped shape such that a distance between the electrodes increases gradually or suddenly.

11. A self-recovery current limiting fuse according to claim 9, wherein the paired electrodes are formed from a high-melting-point material or an alloy which contains the high-melting-point material, and the high-melting-point material and the alloy are resistant to arc and electrolytic corrosion.

12. A self-recovery current limiting fuse according to claim 9, further comprising a magnetic-field-intensity-varying apparatus capable of varying magnetic field intensity of the magnetic field generation section, wherein, upon reception of a signal indicative of detection of overcurrent from an overcurrent detection section provided in series with the self-recovery current limiting fuse, or an emergency trip signal or an off operation check signal from an emergency trip input section, the magnetic-field-intensity-varying apparatus greatly varies the magnetic field intensity for bringing the fuse element into said off state.

13. A self-recovery current limiting fuse according to claim 9, wherein a permanent magnet, a magnetic field generation coil, or a magnetic field generated by current flowing through a wiring line to the self-recovery current limiting fuse is used singly or in combination as the magnetic field generation section.

14. A self-recovery current limiting fuse according to claim 13, wherein intensity of a magnetic field generated by the magnetic field generation section is varied by means of varying a relative position between the magnetic field generation section and the insulative container or varying current applied to the magnetic field generation coil.

15. A self-recovery current limiting fuse according to claim 9, wherein setting of cutoff current is varied by means of varying intensity of a magnetic field generated by the magnetic field generation section.

16. A self-recovery current limiting fuse comprising:

an insulated container comprising a nonmagnetic material;

a liquid matrix of a nonmagnetic material arranged in said insulated container;

a first electrode arranged in said insulated container;

a second electrode arranged in said insulated container, said first electrode being opposite said second electrode, at least a portion of said liquid matrix being located between said first electrode and said second electrode;

a fuse element comprising conductive particles, said conductive particles being arranged in said liquid matrix; and a magnetic field generation section located at a position outside of said insulated container, said magnetic field generation section generating a magnetic field having a component in a direction perpendicular to said fuse element, the magnetic field and current passing through the fuse element generating a resultant electromagnetic force in response to an overcurrent through said fuse element, said conductive particles being connected to one another to form a conductive pattern to define an on state of said fuse element when said resultant electromagnetic force is below a predetermined electromagnetic force, said conductive particles defining a current blocking pattern to provide an off state of said fuse element when said resultant electromagnetic force is above the predetermined electromagnetic force.

17. A self-recovery current limiting fuse according to claim 16, wherein each of the first electrode and said second electrode is formed into a sloped or stepped shape such that a distance between the first electrode and the second electrode increases gradually or suddenly.

18. A self-recovery current limiting fuse according to claim 16, wherein the first electrode and the second electrode are formed from a high-melting-point material or an alloy which contains the high-melting-point material, and the high-melting-point material and the alloy are resistant to arc and electrolytic corrosion.

19. A self-recovery current limiting fuse according to claim 16, further comprising a magnetic-field-intensity-varying apparatus capable of varying magnetic field intensity of the magnetic field generation section, wherein, upon reception of a signal indicative of detection of overcurrent from an overcurrent detection section provided in series with the self-recovery current limiting fuse, or an emergency trip signal or an off operation check signal from an emergency trip input section, the magnetic-field-intensity-varying apparatus greatly varies the magnetic field intensity for bringing the fuse element into said off state.

20. A self-recovery current limiting fuse according to claim 16, wherein a permanent magnet, a magnetic field generation coil, or a magnetic field generated by current flowing through a wiring line to the self-recovery current limiting fuse is used singly or in combination as the magnetic field generation section.

* * * * *